US008456075B2

(12) United States Patent
Axelsson

(10) Patent No.: US 8,456,075 B2
(45) Date of Patent: Jun. 4, 2013

(54) FLUORESCENT LAMP FOR COLD ENVIRONMENTS

(75) Inventor: Folke Axelsson, Ramdala (SE)

(73) Assignee: Auralight International AB (SE)

( * ) Notice: Subject to any disclaimer, the term of this patent is extended or adjusted under 35 U.S.C. 154(b) by 0 days.

(21) Appl. No.: 10/595,208

(22) PCT Filed: Sep. 30, 2004

(86) PCT No.: PCT/SE2004/001396

§ 371 (c)(1),
(2), (4) Date: Jan. 31, 2007

(87) PCT Pub. No.: WO2005/031796

PCT Pub. Date: Apr. 7, 2005

(65) Prior Publication Data

US 2007/0210687 A1 Sep. 13, 2007

Related U.S. Application Data

(60) Provisional application No. 60/481,468, filed on Oct. 6, 2003.

(30) Foreign Application Priority Data

Sep. 30, 2003 (SE) ..... 0302595-4

(51) Int. Cl.
*H01J 5/48* (2006.01)
*H01J 5/50* (2006.01)

(52) U.S. Cl.
USPC ..... 313/318.08; 313/317; 313/318.01; 313/318.1; 313/312; 313/324

(58) Field of Classification Search
USPC ..... 313/324, 317, 318.08, 318.01, 318.1, 313/11, 312
See application file for complete search history.

(56) References Cited

U.S. PATENT DOCUMENTS 2,135,696 A * 11/1938 Baumhauer et. al. ..... 362/647
2,363,109 A * 11/1944 Keiffer ..... 313/25
2,791,679 A * 5/1957 Hierholzer, Jr. et al. ..... 362/645
3,124,307 A * 3/1964 Hoskins et al. ..... 362/659
3,179,792 A * 4/1965 Weiss ..... 362/645
3,358,167 A * 12/1967 Shanks ..... 313/25

(Continued)

*Primary Examiner* — Anne Hines
*Assistant Examiner* — Jose M Diaz
(74) *Attorney, Agent, or Firm* — Schwegman Lundberg & Woessner, P.A.

(57) ABSTRACT

The invention relates to a fluorescent lamp (1) adapted for cold environments, which comprises an elongated main tube (11), fixing devices (12) at each end of the fluorescent lamp (1) for fixing the fluorescent lamp (1) in a light fitting (27), two electrodes (15) placed inside the main tube (11), a heat-insulating outer tube (20) that surrounds the main tube (11) and creates an airspace (22) between the main tube (11) and the outer tube (20). Each fixing device (12) comprises an end cap (41) with a radial part (41*b*), that delimits an outer end plane of the fluorescent lamp (1), and with an axial peripheral part (41*a*), that is connected to an end of the outer tube (20). An axial spacer (29, 31) with low heat conductivity has a first end part (33) that is connected to an end (34) of the main tube (11) and a second end part (38) that adjoins the outer end plane and keeps the main tube (11) separate from the end cap (41) in order to reduce the transmission of heat from the main tube (11) to the end cap (41) and the outer tube (20).

4 Claims, 2 Drawing Sheets

U.S. PATENT DOCUMENTS 3,453,470 A * 7/1969 Hammer ..... 313/25
3,602,759 A * 8/1971 Evans ..... 313/112
3,673,401 A * 6/1972 Du Pont ..... 362/377
3,751,653 A * 8/1973 Henry ..... 362/126
3,808,495 A * 4/1974 Win ..... 313/110
4,048,537 A * 9/1977 Blaisdell et al. ..... 313/489
4,112,485 A * 9/1978 Sutter ..... 362/369
4,924,368 A * 5/1990 Northrop et al. ..... 362/376
5,188,451 A * 2/1993 Shanks ..... 362/223
5,291,379 A * 3/1994 Lu ..... 362/255
5,536,998 A * 7/1996 Sica ..... 313/489
6,078,136 A * 6/2000 Sica ..... 313/493
6,254,318 B1 * 7/2001 Sica ..... 408/39
6,406,167 B1 * 6/2002 Bock ..... 362/376
6,422,721 B1 * 7/2002 Plunk et al. ..... 362/377
6,452,325 B1 * 9/2002 Dupont ..... 313/489
7,164,223 B2 * 1/2007 Lee ..... 313/17
7,477,005 B2 * 1/2009 Hlahol et al. ..... 313/11

* cited by examiner

FLUORESCENT LAMP FOR COLD ENVIRONMENTS

RELATED APPLICATIONS

This application is a US National Stage application under 35 U.S.C. §371 of International Application Serial No. PCT/SE2004/001396, filed Sep. 30, 2004 and published as WO/2005/031796 A1 on Apr. 7, 2005, which claims the priority benefit of Sweden Application Serial No. 0302595-4, filed Sep. 30, 2003, and also claims the priority benefit of U.S. Provisional Application Ser. No. 60/481,468, filed Oct. 6, 2003, the contents of which applications and publication(s) are incorporated herein by reference in their entirety.

TECHNICAL FIELD

The present invention relates to a fluorescent lamp adapted for cold environments and comprising an elongated main tube, a fixing device at each end of the fluorescent lamp for fixing the fluorescent lamp in a light fitting, two electrodes provided with emitter material placed inside the main tube, a heat-insulating outer tube that surrounds the main tube and creates an airspace between the main tube and the outer tube in order to insulate the main tube of the fluorescent lamp from a cold surrounding atmosphere, with each fixing device comprising an end cap with a radial part that delimits an outer end plane of the fluorescent lamp, and with an axial peripheral part.

BACKGROUND ART

Fluorescent lamps are currently used to a great extent in cold environments, such as for example freezers. Known fluorescent lamps are, however, bulky and require a lot of energy. A commonly-found type of fluorescent lamp is a so-called "T8" fluorescent lamp (26 mm external diameter), that can be built in behind the door pillar of the freezer. This type of fluorescent lamp requires a U-shaped transparent polycarbonate shield, which is intended to shield the fluorescent lamp from cooling and mechanical damage. This cold shield is, however, inadequate and therefore the fluorescent lamp becomes too cold and has a mercury vapour pressure that is too low, which in turn means that the energy transformation of the mercury to the ultraviolet wavelength 253.7 nm (the ultraviolet wavelength 253.7 nm is converted in the tube's phosphor to visible light) is greatly reduced. The energy efficiency of the fluorescent lamp is therefore low. The abovementioned problem is generally solved by utilizing fluorescent lamps with high energy consumption, so that the energy efficiency and the illumination increase. This is, however, an expensive way of solving the abovementioned problem.

Another problem with known technology is that, when slimline fluorescent lamps that are currently available, such as "T5" fluorescent lamps (17 mm external diameter), are used in the freezer, in order to make more room for food, for example, the sensitivity of these fluorescent lamps to cold results in a shorter life and lower energy efficiency and a lower level of illumination.

An additional problem is that known fluorescent lamps adapted for cold environments, which fluorescent lamps have a larger external diameter, for example 38 mm, do not fit inside existing plastic shields, such as a transparent U-shaped polycarbonate shield. This plastic shield also produces a reflection, that dazzles a viewer who wants to see the illuminated goods.

Fluorescent lamps of the standardized type "T5" are based on high-frequency operation (frequencies above 20 kHz) and have the following important differences compared to fluorescent lamps with 50 Hz operation, which have to date dominated previously-known fluorescent lamps of the "thermo" type:

the two electrodes of the fluorescent lamp work in general both as anodes and cathodes, as the fluorescent lamp is operated with alternating current. The electrodes emit electrons to the discharge when they work as cathodes and receive electrons when they work as anodes. High-frequency operation means that, in the anode phase, the electrodes are heated up a very small amount by the stream of electrons, while the heating up at 50 Hz is considerably larger, as the anode voltage drop is higher at 50 Hz and the kinetic energy of the electrons is accordingly greater when they strike the cathode surface. The heat generation in the electrodes is thus reduced by approximately 50% for high-frequency operation in comparison to 50 Hz operation.

A problem with known thermofluorescent lamps of the high-frequency type has been that the temperature inside the fluorescent tube behind the electrodes, that is near the end caps, becomes lower due to the conduction of heat from the inner tube (the fluorescent tube) to the end caps and then to the outer tube, with the result that the danger of cold spots at the ends increases with high-frequency operation (lower temperature than at the middle of the tube), allowing the mercury to condense.

Through U.S. Pat. No. 6,078,136, a fluorescent lamp of the type mentioned in the introduction is already known. A heat-insulating, sleeve-shaped radial spacer is arranged between an inner fluorescent tube and a surrounding outer protective tube in order to maintain a required distance between the tubes and to achieve a heat insulation between them at the ends. A metal end cap has an axial peripheral part that is connected to the inner fluorescent tube, whereby heat can be conducted to the end cap. A shrunk-on plastic cover holds the outer tube fixed in the end cap.

DISCLOSURE OF INVENTION

An object of the present invention is to avoid these disadvantages associated with known fluorescent lamps of the type in question.

The above-mentioned problems have been solved by a fluorescent lamp according to the invention that has the characteristics according to claim 1. Thus, the fluorescent lamp according to the invention of the type mentioned in the introduction is characterized in that the axial peripheral part of the end cap is connected to an end of the outer tube, and in that an axial spacer with low heat conductivity has a first end part that is connected to an end of the main tube, and a second end part that adjoins the outer end plane and keeps the main tube separate from the end cap in order to reduce the heat conduction from the main tube to the end cap and the outer tube. By this means, there is a minimal heat transmission from the inner fluorescent tube to the end cap located behind this and to the surrounding outer tube. In this way, a spacing function is achieved, while at the same time the transmission path for heat from the main tube to the outer tube connected to the end cap is made longer. This further reduces the heat conduction.

The working temperature of the fluorescent lamp can be retained in cold environments, so that the mercury vapour pressure created in the fluorescent lamp is such that the energy transformation of the mercury to the ultraviolet wavelength 253.7 nm is retained at an energy-optimal level. The fluorescent lamp according to the invention withstands cold in a satisfactory way in comparison to known fluorescent lamps intended for cold environments.

Additional characteristics of the fluorescent lamp according to the invention are to be found in the independent patent claims and are apparent from the following detailed description with reference to the attached drawings.

MODES FOR CARRYING OUT THE INVENTION

Figure 1:
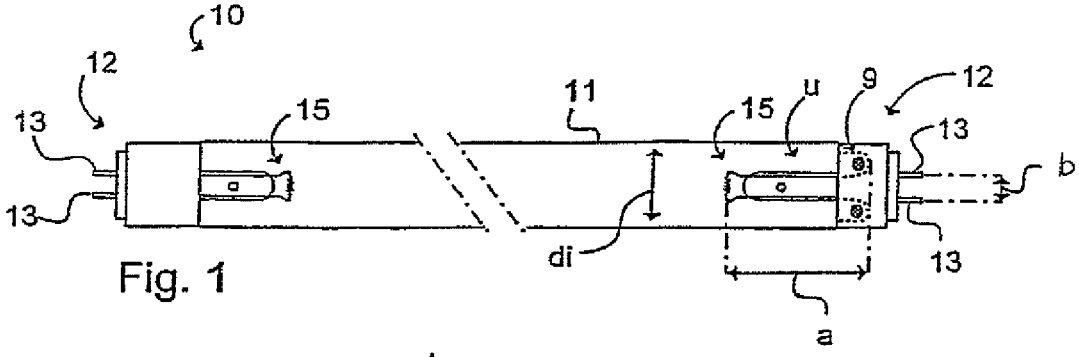
FIG. 1 shows schematically a side view of a previously-known slimline fluorescent lamp of the type "T5"

FIG. 1 shows an elongated fluorescent lamp 10 comprising a main tube 11 according to known technology. A fixing device 12 is arranged at each end, which fixing device comprises two pins 13 at a distance b apart. The fixing device 12 is intended to hold the fluorescent lamp 10 in a light fitting. The known fluorescent lamp 10 illustrated is a slimline fluorescent lamp, a so-called "T5" fluorescent lamp of the high-frequency type, designed for small spaces and very compact. The fluorescent lamp 10 comprises, in addition, two electrodes 15 provided with emitter material. One electrode 15 is placed at a distance a from the fixing device 12. The distance a and the internal diameter di of the main tube 11 define an inner space u for determining the lowest temperature zone 9 of the fluorescent lamp 10 and hence the mercury vapour pressure in the fluorescent lamp 10. The distance a is so large that the mercury condenses in an area closest to the fixing device 12, corresponding to the lowest temperature zone 9, whereupon the inner space u changes to being a colder space in the main tube 11. As slimline fluorescent lamps have a general tendency to create a high working temperature, on account of their more compact design, the fluorescent lamp 10 has been provided with the electrode 15 at a distance a from the fixing device 12, or in other words from a wall that forms the end of the main tube. This distance a and the internal diameter di of the main tube 11 define the area of the inner space u.

Figure 2:
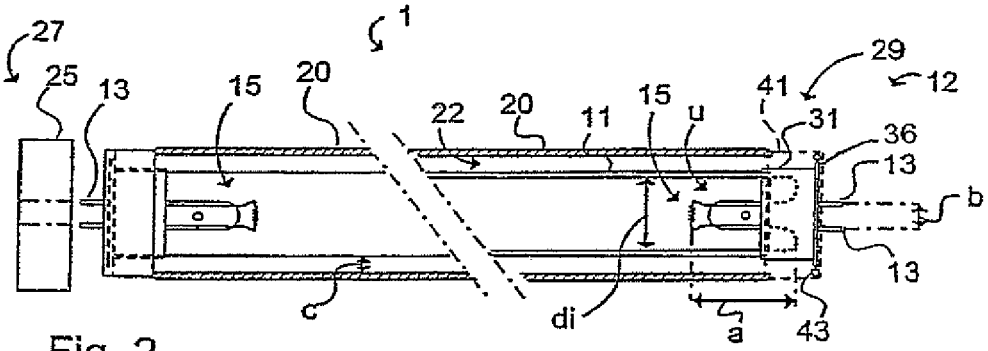
FIG. 2 shows schematically a side view of a fluorescent lamp adapted for use in cold environments, according to an embodiment of the invention, that takes up less space.

FIG. 2 shows a fluorescent lamp 1 adapted for cold environments in accordance with an embodiment of the present invention. In order for the fluorescent lamp 1 to be able to withstand cold, a heat-insulating outer tube 20 has been arranged around the main tube 11 and encloses it completely in the longitudinal direction, whereby an air space 22 is created in the shape of an imaginary cylinder located between the main tube 11 and the outer tube 20, which insulates the main tube 11 of the fluorescent lamp 1 from the cold environment.

The inner space u for determining the lowest temperature zone of the fluorescent lamp 1 is arranged in such a way that, by reduction of the distance a, a mercury vapour pressure created in the fluorescent lamp 1 becomes such that the energy transformation of the mercury to the ultraviolet wavelength 253.7 nm is retained when the fluorescent lamp 1 is used in the cold environment, such as in a freezer. By reducing the distance a, the inner space u becomes warmer. That is to say, by reducing the distance a, the fluorescent lamp 1 is not cooled down, whereby the mercury vapour pressure can be just high enough for the power generated within the ultraviolet wavelength 253.7 nm to be as high as possible when the fluorescent lamp 1 is used in the freezer. At the ultraviolet wavelength 253.7 nm, phosphor (not shown) applied on the inside of the main tube 11 is converted to visible light in an optimal way.

By reducing the distance c between the outside of the main tube 11 and the inside of the outer tube 20, the inner space u can be made warmer and by increasing the distance c, the inner space u can be made colder. This distance is preferably approximately 3.0-11.0 mm, preferably 4.0-8.0 mm. By varying the distance c, an operator can modify the fluorescent lamp 1 to suit the requirements of the customer, concerning, for example, a surrounding temperature of −40° C. and requirements for maximal power utilization (for example a maximum of 35 W).

A slimline fluorescent lamp, or a so-called "T5" fluorescent lamp, has thus been arranged with the characteristics described above in order to be adapted for use in cold environments. Accordingly, the fluorescent lamp 1 is specially adapted to take up as little space as possible while, at the same time, the energy efficiency of the fluorescent lamp 1 remains satisfactory.

In addition, FIG. 2 shows a contact point 25 in a light fitting 27 in the freezer. The pins 13 of the fixing device 12 are electrically connected to the electrode 15 and can be inserted into the contact point 25. The fixing device 12 comprises, in addition, an axial spacer 29 designed to minimize the heat conduction from the main tube 11 to an end cap 41 and the outer tube 20. FIG. 2 shows the spacer 29 with a sleeve part 31 and a radially-projecting guide element 36 in order to make easier the assembly of the outer tube and the end cap when assembling the fluorescent lamp 1, and with a separate heat-insulating spacing ring 43, which is in contact with the outer edge of the guide element 36 and with the end cap 41.

Figure 3:
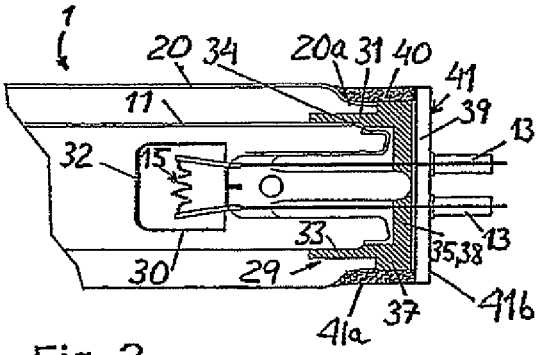
FIG. 3 is a partially-sectioned side view of an end part of the fluorescent lamp according to the invention, showing the placing of a spacer between the inner main tube and the end cap.

A preferred embodiment of the spacer 29 will now be described in greater detail with reference to FIGS. 3 and 4*a*-4*b*. The spacer 29 has a cylindrical sleeve 31. One end 33 of the spacer 29 surrounds one end 34 of the main tube 11, and the other end 35 has a guide element in the form of radially-projecting lugs 37, against which the end surface of the outer tube 20 can make contact. The end 35 also forms a bottom part 38 of the spacer 29, which, together with a disk 39, keeps the main tube 11 separated from and insulated from the end cap 41 that is in the shape of a bowl and is made of metal, which end cap, by means of an axially-peripheral part 41*a*, surrounds the spacer 29 and the end parts 20*a*, 34 of the main tube 11 and the outer tube 20 over a joining layer 40 of insulating mastic. The end cap 41 has a radial part 41*b* that delimits an outer end plane of the fluorescent lamp 1. The spacer 29 is manufactured of, for example, a plastic material that is heat-resistant and is not combustible. The spacer 29 thus joins together the end cap 41 with the main tube 11 and the outer tube 20 in a simple way, while at the same time there is minimal heat transmission to the end cap 41.

A cup-shaped cover 30 with a hole 32 encloses the electrode 15 and is electrically insulated from this. By this means, the life of the fluorescent lamp 1 intended for cold environments is extended, as vaporized atoms and molecules are reflected back to the electrode 15 to a greater extent. As cold environments belonging to certain users are switched on and off more frequently, the running costs can thereby be reduced.

Figure 4A:
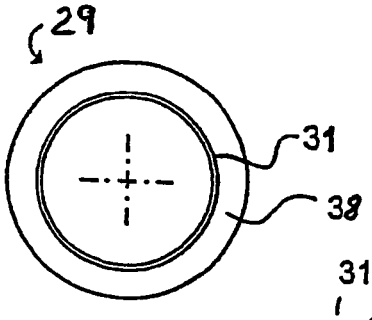
FIG. 4*a* is a schematic end view of a spacer according to the invention.
Figure 4B:
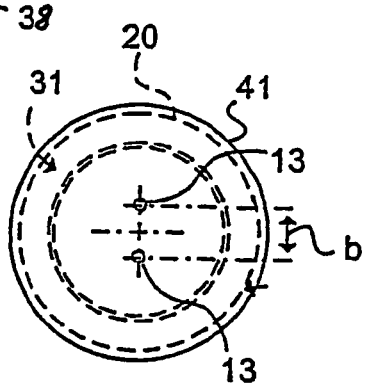
FIG. 4*b* is a schematic end view of the fluorescent lamp in FIG. 3.

FIG. 4*a* shows an end view of the spacer 29, viewed in the direction from the main tube 11, and FIG. 4*b* shows an end view of the fluorescent lamp 1, viewed in the opposite direction.

Figure 5A:
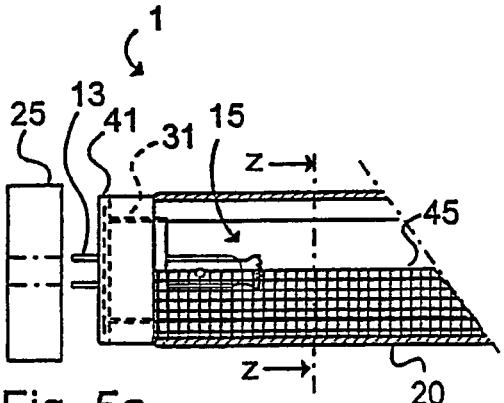
FIG. 5*a* shows schematically an end part of an additional embodiment of the fluorescent lamp according to the invention.
Figure 5B:
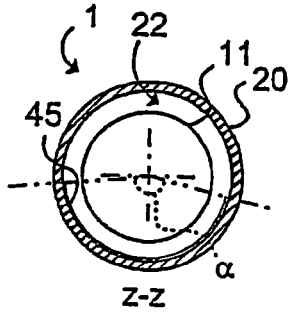
FIG. 5*b* shows schematically a cross-section along the line Z-Z in FIG. 5*a*.

FIG. 5*a* shows an embodiment where the inside of the outer tube 20 of the fluorescent lamp 1 has a reflective coating 45 applied over the whole length of the outer tube 20 and with a peripheral angle $\alpha$ of 60-300°, preferably 140-200°. In FIG. 5*b*, that shows schematically a cross section Z-Z of the fluorescent lamp 1 in FIG. 5*a*, the reflective coating 45 has a peripheral angle $\alpha$ of approximately 170°. By this means, illumination can be improved by 30-40% in a freezer 47 (shown in FIG. 6).

The outer tube 20 is oriented with its reflective coating 45 in such a position in relation to the plane of the contact pins 13, that a viewer is not dazzled.

A transparent plastic film (for example of the type FEP, Fluorinated Ethylene Propylene) is shrunk onto the outer tube 20. By this means, frozen goods in the freezer can be protected against substances that are in the fluorescent lamp, such as for example mercury, phosphor, splinters of glass, etc, in the event of damage to the fluorescent lamp.

Figure 6:
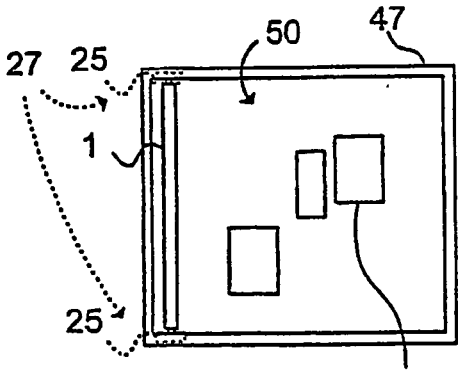
FIG. 6 shows schematically a freezer with a fluorescent lamp according to FIG. 3.

FIG. 6 shows the freezer 47 with a cold environment 50. The fluorescent lamp 1 is mounted in a light fitting 27 in the freezer 47. The fluorescent lamp 1 takes up less space than known fluorescent lamps adapted for cold environments 50, as a result of which additional space is created in the freezer for frozen goods 51, while at the same time the operating costs can be reduced.

The invention claimed is:

1. A fluorescent lamp adapted for cold environments, comprising:

an elongated main tube, a fixing device at each end of the fluorescent lamp for fixing the fluorescent lamp in a light fitting, two electrodes provided with emitter material placed inside the main tube, a heat-insulating outer tube that surrounds the main tube and creates an airspace between the main tube and the outer tube in order to insulate the main tube of the fluorescent lamp from a cold surrounding atmosphere, each fixing device comprising a metal end cap with a radial part and an axial peripheral part, wherein the radial part delimits an outer end plane of the fluorescent lamp, a one-piece axial spacer made entirely of a material with low heat conductivity which has a first end part which holds and centers an end of the main tube, and a second end part that forms a bottom part that is substantially planar and adjoins said outer end plane and keeps the main tube separate from the metal end cap in order to reduce the transmission of heat from the main tube to the metal end cap and to the outer tube, wherein the second end part of the spacer has a plurality of outwardly radially-projecting guide elements in the form of radial lugs distributed with intermediate spaces between them around the circumference of said axial spacer, against which the end of the outer tube abuts, wherein the axial peripheral part of the metal end cap surrounds the one-piece axial spacer and the end part of the main tube, and surrounds the end of the outer tube and couples to the outer tube by a joining layer of insulation mastic.

2. The fluorescent lamp of claim 1, further including:

a cup-shaped cover enclosing one of the two electrodes and electrically insulated from the enclosed electrode.

3. The fluorescent lamp of claim 1, further including:

a reflective coating on the inside of the outer tube, the reflective coating applied over the whole length of the outer tube.

4. The fluorescent lamp of claim 1, wherein the airspace between the main tube and the outer tube has a distance in the range of 4.0 to 8.0 mm.

* * * * *